US009895893B2

(12) United States Patent
Yamazaki et al.

(10) Patent No.: US 9,895,893 B2
(45) Date of Patent: Feb. 20, 2018

(54) PRINTER AND PRINTING METHOD

(71) Applicant: Seiko Epson Corporation, Tokyo (JP)

(72) Inventors: Yukie Yamazaki, Shiojiri (JP); Kimitaka Kamijo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/167,786

(22) Filed: May 27, 2016

(65) Prior Publication Data

US 2016/0271954 A1 Sep. 22, 2016

Related U.S. Application Data

(63) Continuation of application No. 14/626,133, filed on Feb. 19, 2015, now Pat. No. 9,352,570.

(30) Foreign Application Priority Data

Feb. 19, 2014 (JP) ..... 2014-029354

(51) Int. Cl.
*B41J 2/165* (2006.01)

(52) U.S. Cl.
CPC ..... *B41J 2/16517* (2013.01); *B41J 2/16508* (2013.01); *B41J 2/16526* (2013.01); *B41J 2/16588* (2013.01); *B41J 2002/16529* (2013.01)

(58) Field of Classification Search
CPC ..... B41J 2/16517; B41J 2/16508; B41J 2/16526; B41J 2/16588; B41J 2002/16529
See application file for complete search history.

(56) References Cited

U.S. PATENT DOCUMENTS 5,659,342 A * 8/1997 Lund ..... B41J 2/16526 347/24
5,903,288 A 5/1999 Yamaguchi
2003/0025745 A1 2/2003 Kawatoko et al.
2005/0195236 A1* 9/2005 Suzuki ..... B41J 2/16526 347/19
2005/0270313 A1* 12/2005 Oshio ..... B41J 2/16526 347/5
2005/0270323 A1* 12/2005 Oshio ..... B41J 2/16526 347/14

(Continued)

FOREIGN PATENT DOCUMENTS

JP 11-192729 A 7/1999
JP 2004-090264 A 3/2004

(Continued)

OTHER PUBLICATIONS

U.S. Appl. No. 14/626,133, filed Feb. 19, 2015, Printer and Printing Method.

*Primary Examiner* — Justin Seo
(74) *Attorney, Agent, or Firm* — Nutter McClennen & Fish LLP; John J. Penny, Jr.; Alex Nagorniy

(57) ABSTRACT

A control unit 6 of a printer 1 determines the combination of conditions of regular flushing that ejects ink into a maintenance unit 5, and onto-paper flushing that ejects ink onto printing paper P, based on the set print mode. To achieve the dot density defined by the selected combination, flushing dots Df are added to the input data 10 to be printed and are printed. When printing, regular flushing is executed at the frequency and strength determined by the selected combination of conditions.

8 Claims, 6 Drawing Sheets

73

| | REGULAR FLUSHING | | ONTO-PAPER FLUSHING |
|---|---|---|---|
| | FREQUENCY | STRENGTH | |
| PRINT QUALIT PRIORITY MODE | FIRST FREQUENCY (HIGH FREQUENCY) | FIRST STRENGTH (LOW INK EJECTION VOLUME) | SECOND DENSITY (LOW DENSITY) |
| PRINT TIME PRIORITY MODE | SECOND FREQUENCY (LOW FREQUENCY) | SECOND STRENGTH (HIGH INK EJECTION VOLUME) | FIRST DENSITY (HIGH DENSITY) |

(56) References Cited

U.S. PATENT DOCUMENTS

| | | | | |
|---|---|---|---|---|
| 2005/0275687 | A1* | 12/2005 | Furuichi | B41J 2/16526 347/43 |
| 2006/0055715 | A1 | 3/2006 | Nakahara et al. | |
| 2006/0061617 | A1 | 3/2006 | Udagawa | |
| 2009/0002412 | A1* | 1/2009 | Kawakami | B41J 2/155 347/8 |
| 2009/0167802 | A1 | 7/2009 | Suzuki et al. | |
| 2010/0091053 | A1* | 4/2010 | Jackson | B41J 2/2139 347/9 |
| 2013/0083121 | A1* | 4/2013 | Higashikawa | B41J 2/1714 347/30 |
| 2014/0139580 | A1 | 5/2014 | Sato et al. | |
| 2015/0091976 | A1* | 4/2015 | Mizutani | B41J 2/16508 347/23 |
| 2015/0231886 | A1 | 8/2015 | Yamazaki et al. | |

FOREIGN PATENT DOCUMENTS

| | | | |
|---|---|---|---|
| JP | 2005-161615 | A | 6/2005 |
| JP | 2005-246643 | A | 9/2005 |
| JP | 2006-076247 | A | 3/2006 |
| JP | 2006-088413 | A | 4/2006 |
| JP | 2006-123499 | A | 5/2006 |
| JP | 2009-154297 | A | 7/2009 |

* cited by examiner

73

| | REGULAR FLUSHING | | ONTO-PAPER FLUSHING |
|---|---|---|---|
| | FREQUENCY | STRENGTH | |
| PRINT QUALIT PRIORITY MODE | FIRST FREQUENCY (HIGH FREQUENCY) | FIRST STRENGTH (LOW INK EJECTION VOLUME) | SECOND DENSITY (LOW DENSITY) |
| PRINT TIME PRIORITY MODE | SECOND FREQUENCY (LOW FREQUENCY) | SECOND STRENGTH (HIGH INK EJECTION VOLUME) | FIRST DENSITY (HIGH DENSITY) |

FIG. 4

| | REGULAR FLUSHING | | ONTO-PAPER FLUSHING |
|---|---|---|---|
| | FREQUENCY | STRENGTH | |
| PRINT QUALIT PRIORITY MODE | FIRST FREQUENCY (HIGH FREQUENCY) | FIRST STRENGTH (LOW INK EJECTION VOLUME) | SECOND DENSITY (LOW DENSITY) |
| PRINT TIME PRIORITY MODE | SECOND FREQUENCY (LOW FREQUENCY) | SECOND STRENGTH (HIGH INK EJECTION VOLUME) | FIRST DENSITY (HIGH DENSITY) |

PRINTER AND PRINTING METHOD

Priority is claimed under 35 U.S.C. § 120 as a continuation of U.S. application Ser. No. 14/626,133, filed Feb. 9, 2015, now U.S. Pat. No. 9,352,570, entitled "Printer and Printing Method," and under 35 U.S.C. § 119 to Japanese Application no. 2014-023954, filed on Feb. 19, 2014 which are hereby incorporated by reference in their entireties.

BACKGROUND

1. Technical Field

The present disclosure relates to a printer that prints by ejecting ink droplets from ink nozzles, and to a printing method.

2. Related Art

In printers that print by ejecting ink from ink nozzles, the ink nozzles can become clogged as a result of moisture evaporating from the ends of the nozzles and ink viscosity increasing in ink nozzles from which ink is not ejected for a particular time or longer. As a result, ink cannot be ejected normally from ink nozzles with a low ejection frequency, and print quality may drop. Ink nozzles becoming clogged can be prevented or corrected, however, by providing a maintenance unit inside the printer and ejecting ink into the maintenance unit in a flushing operation (referred to below as regular flushing). Ink may also be ejected onto the printing paper (referred to below as "onto-paper flushing") to prevent or resolve ink nozzle clogging.

A drop in throughput is a problem with regular flushing because the printhead must first be moved to the maintenance unit. To suppress the drop in throughput and increased ink consumption as a result of performing the regular flushing operation at a regular time interval, JP-A-H11-192729 controls flushing according to the printed content so that flushing is not performed more than necessary. For example, when multiple copies of the same content are printed, the nozzles that were used to print the previous page are not flushed. The time for which ink was not ejected from the nozzles is also measured, and only those nozzles for which the measured time exceeds a reference value are flushed.

Various methods are thus used for flushing, and each method has its advantages and disadvantages. For example, regular flushing does not adversely affect print quality, but contributes to a drop in throughput. Furthermore, while the drop in throughput caused by regular flushing can be reduced by the control method described in JP-A-H11-192729, it cannot be completely eliminated. On the other hand, because the onto-paper flushing method can be used parallel the printing operation, it does not contribute to a drop in throughput. However, because ink is discharged onto the printing paper, the flush onto paper method contributes to a drop in print quality.

Some printers also have print modes such as a throughput-priority mode (a so-called "fast mode") that prioritizes shortening the required printing time, and a print quality-priority mode (a so-called "clean mode") that prioritizes maintaining print quality. The desirable flushing mode differs according to the print mode in these printers.

When print conditions such as the print speed and print resolution can be set in multiple levels, the desirable flushing method also differs according to the print conditions. Applying the appropriate flushing method according to the print mode or print conditions is therefore desirable.

SUMMARY

The present invention is directed to solving the foregoing problem by providing a printer and a print method that can balance throughput and print quality while suppressing ink nozzle ejection problems by combining flushing operations that eject ink into the maintenance unit, and flushing operations that eject ink onto the print medium.

A printer according to one aspect of the invention has a printhead with ink nozzles; a maintenance unit that receives ink ejected from the ink nozzles; a head moving mechanism that moves the printhead to a print position to print on a recording medium, and a maintenance position to eject ink to the maintenance unit; a parameter decision unit that determines a combination of first flushing conditions for ejecting ink to the maintenance unit and flushing the ink nozzles, and second flushing conditions for ejecting ink onto the recording medium and flushing the ink nozzles; a merging unit that generates merged data adding to image data a pattern of flushing dots that are formed by the second flushing based on the selected second flushing conditions; and a first flushing unit that applies the first flushing based on the selected first flushing conditions to the printhead.

A printing method according to another aspect of the invention includes: determining a combination of first flushing conditions for ejecting ink from ink nozzles of a printhead to a maintenance unit and flushing the ink nozzles, and second flushing conditions for ejecting ink onto a recording medium and flushing the ink nozzles; generating merged data adding to image data a pattern of flushing dots that are formed by the second flushing based on the selected second flushing conditions; ejecting ink onto the recording medium based on the merged data; and applying the first flushing based on the selected first flushing conditions.

The printer and printing method of the invention maintain ink nozzles using a combination of a first flushing operation that ejects ink into a maintenance unit, and a second flushing operation that ejects ink onto the recording medium. More specifically, both a first flushing that does not lower print quality, and a second flushing that does not lower throughput, can be used together and desirably combined. Ejection problems from the ink nozzles can therefore be suppressed during printing while desirably balancing print quality and throughput according to the application and conditions when printing.

Preferably, the printer also has a print mode setting unit that sets the print mode to either a first print mode or a second print mode that shortens the time required for printing compared with the first print mode; and the parameter decision unit determines the combination of first flushing conditions and second flushing conditions based on the set print mode.

The printing method preferably also includes setting the print mode to either a first print mode or a second print mode that shortens the time required for printing compared with the first print mode; and determining the combination of first flushing conditions and second flushing conditions based on the set print mode.

Thus comprised, when setting print modes having different priorities, the objective can be achieved by desirably combining first and second flushing operations according to the selected priority. For example, first flushing, which does not lower print quality, is primarily applied in a mode that prioritizes print quality (a second print mode), and second flushing, which does not lower throughput, is primarily used in a mode that prioritizes throughput (first print mode, a mode that shortens the time required for printing). Thus comprised, ink nozzle ejection problems can be suppressed during printing while desirably balancing print quality and throughput according to the print mode.

Further preferably, the printer also has a print quality setting unit that sets the print resolution; and the parameter decision unit determines the combination of first flushing conditions and second flushing conditions based on the set print resolution.

When the period at which flushing dots are printed is the same, this configuration changes the density of the flushing dots formed by onto-paper flushing according to the print resolution. This means the effect of second flushing on print quality is different. Therefore, by combining first and second flushing operations according to the print resolution, ink nozzle ejection problems can be suppressed during printing while desirably balancing print quality and throughput.

A printer according to another aspect of the invention preferably sets the frequency of the first flushing set to either a first frequency or a second frequency that is less frequent than the first frequency as a condition of the first flushing.

When the frequency of the first flushing operation is high, the ink nozzle recovery rate by the first flushing is high. Therefore, by combining first and second flushing operations according to the frequency of the first flushing operation, ink nozzle ejection problems can be suppressed during printing while desirably balancing print quality and throughput.

A printer according to another aspect of the invention preferably sets the density of flushing dots formed in the second flushing to either a first density or a second density that is less dense than the first density as a condition of the second flushing.

When the density of the flushing dots is high in the second flushing operation, the ink nozzle recovery rate by the second flushing is high. Therefore, by combining first and second flushing operations according to the density of the flushing dots, ink nozzle ejection problems can be suppressed during printing while desirably balancing print quality and throughput.

A printer according to another aspect of the invention preferably sets the strength of the first flushing to either a first strength or a second strength that ejects less ink than the first strength as a condition of the first flushing.

When the strength of the first flushing is high (that is, a large amount of ink is ejected), the ink nozzle recovery rate by the first flushing is high. Therefore, by combining first and second flushing operations according to the strength of the first flushing, ink nozzle ejection problems can be suppressed during printing while desirably balancing print quality and throughput.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4 shows an example of a flushing parameter table.

DESCRIPTION OF EMBODIMENTS

Preferred embodiments of a printer and a printing method according to the present invention are described below with reference to the accompanying figures. The following embodiments are described with reference to an inkjet printer, but the invention can also be applied to multifunction printing devices with scanner and facsimile machine functions, for example. Furthermore, the following embodiment is described using an inkjet line printhead, but the invention can obviously also be applied to printing devices with a serial printhead.

Printer

Figure 1:
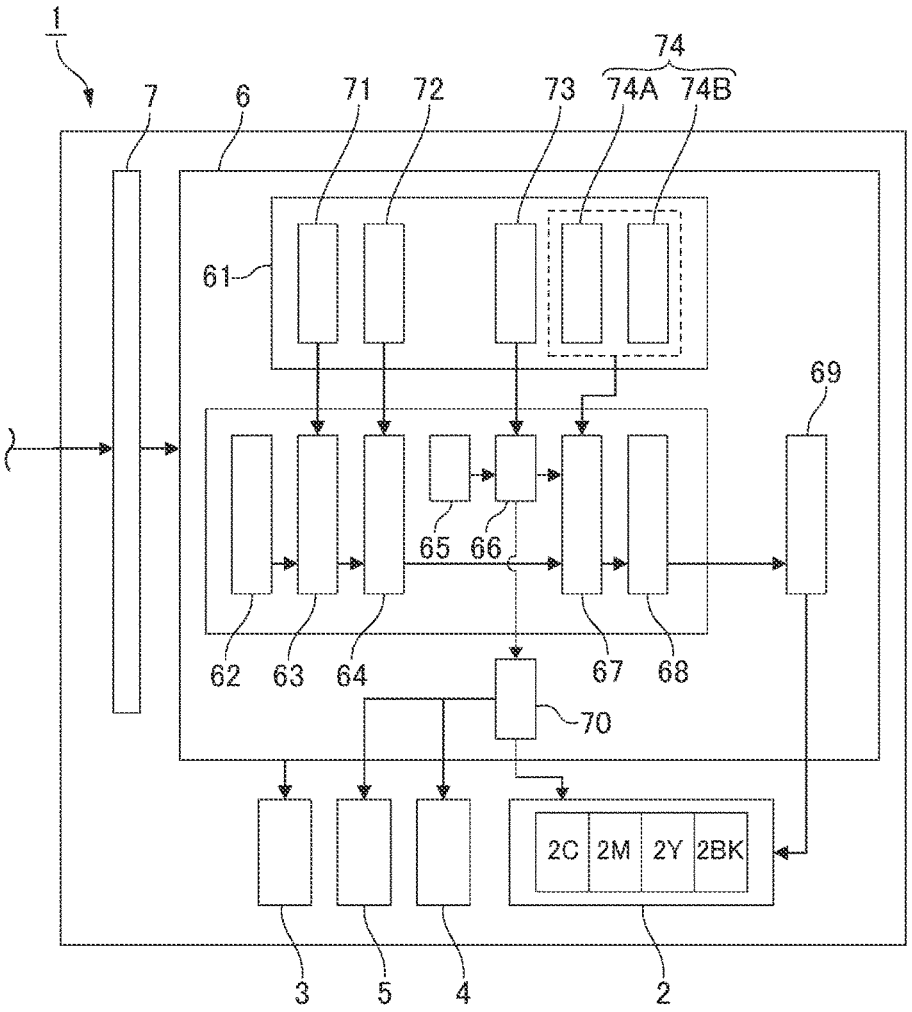
FIG. 1 is a block diagram illustrating the control system of a printer according to the invention.
Figure 2:
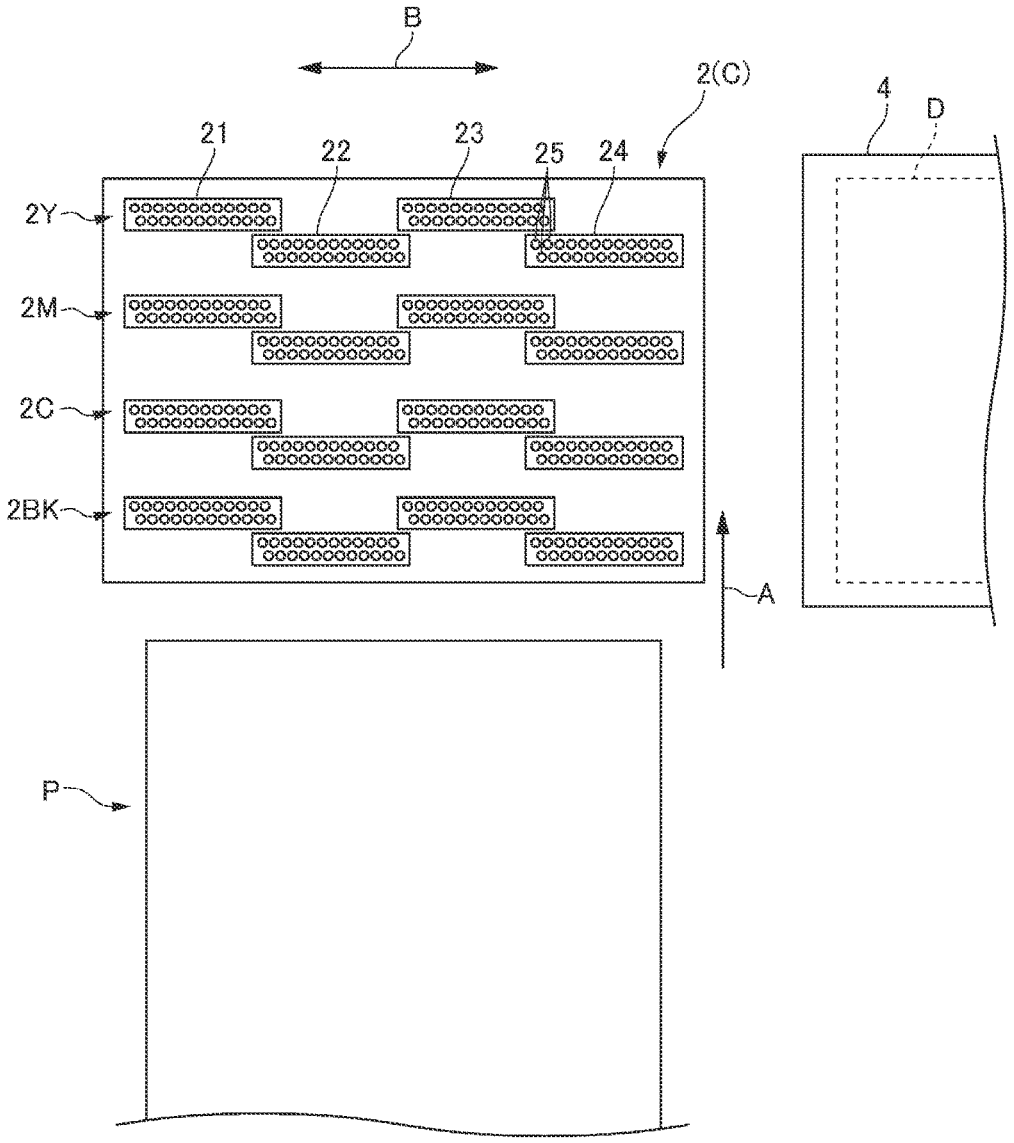
FIG. 2 schematically illustrates the printhead, maintenance unit, and printing paper in the printer shown in FIG. 1.

FIG. 1 is a basic block diagram showing the control system of a printer according to this embodiment of the invention, and FIG. 2 schematically illustrates the relationship between the printhead, maintenance unit, and printing paper in the printer shown in FIG. 1.

As shown in FIG. 1 and FIG. 2, the printer 1 has a printhead 2 that ejects ink droplets in four colors of ink, cyan ink C, magenta ink M, yellow ink Y, and black ink Bk; a conveyance mechanism 3 that conveys the printing paper P (recording medium) through a conveyance path past the position where the printhead 2 prints; a head moving mechanism 4 that moves the printhead 2 in the direction crosswise to the conveyance direction of the printing paper P by the conveyance mechanism 3; a maintenance unit 5; a control unit 6 that controls the printhead 2, conveyance mechanism 3, head moving mechanism 4, and maintenance unit 5; and a communication unit 7 that receives input data to be printed (image data) and print settings information, for example.

The printhead 2 is an inkjet line head, and as shown in FIG. 2 has four sets of inkjet heads 2C, 2M, 2Y, 2Bk arrayed at a specific interval in the conveyance direction A of the printing paper P. The inkjet heads 2C, 2M, 2Y, 2Bk are each longer in the transverse direction B intersecting the conveyance direction A than the maximum width of the printing paper P, and print by ejecting ink onto the printing paper P. The inkjet head 2Bk located furthest upstream in the conveyance direction A of the printing paper P ejects black ink Bk, and the inkjet head 2C on the downstream side of inkjet head 2Bk ejects cyan ink C. The inkjet head 2M located on the downstream side of inkjet head 2C ejects magenta ink M, and the inkjet head 2Y on the downstream side of inkjet head 2M ejects yellow ink Y.

Each of the inkjet heads 2C, 2M, 2Y, 2Bk has four head units 21 to 24 disposed across the transverse direction B. The four head units 21 to 24 are aligned with the adjacent head units staggered in the conveyance direction A. The four head units 21 to 24 also have plural ink nozzles 25 arranged in two rows of ink nozzles disposed at a specific nozzle pitch in the transverse direction B. The nozzle pitch in this example is set to 300 dpi. The positions of the two ink nozzle rows in the transverse direction B are also offset from each other ½ the distance between adjacent nozzles (the nozzle pitch). As shown in FIG. 2, the head units 21, 22 adjacent to each other in the transverse direction B are disposed so that the ink nozzles 25 at the matching ends overlap when seen in the conveyance direction A. Each of the other head units 22, 23 and head units 23, 24 adjacent to each other in the transverse direction B are likewise disposed so that the ink nozzles 25 at the matching ends overlap when seen in the conveyance direction A.

The maintenance unit 5 is located outside the width of the conveyance path. The head moving mechanism 4 moves the printhead 2 between a print position C facing the printing paper P on the conveyance path, and a retracted position D opposite the maintenance unit 5. In the standby mode when not printing, the nozzle face of the printhead 2 is capped by the maintenance unit 5. The regular flushing operation of moving the printhead 2 to the retracted position D opposite the maintenance unit 5 and ejecting ink from the ink nozzles 25 into the maintenance unit 5 is performed at a specific timing before printing starts and while in the standby mode.

This embodiment of the invention also performs the onto-paper flushing operation of ejecting ink droplets from the ink nozzles 25 positioned opposite the printing paper P while printing as described below. During the regular flushing operation, the ink nozzles 25 not used for printing, such as all ink nozzles 25 including the ink nozzles 25 located Outside the printing paper P on the transverse direction B, are flushed. The ink nozzles 25 at a position separated from the printing paper P can therefore also be flushed, and clogging can be prevented or resolved.

Control System

As shown in FIG. 1, the control system of the printer 1 is a control unit 6 including a CPU. A communication unit 7 is connected to the input side of the control unit 6. Input data 10 (see FIG. 3) to be printed, and print settings information such as the print mode, are supplied from an external, device such as a computer through the communication unit 7 to the control unit 6.

The printhead 2, conveyance mechanism 3, head moving mechanism 4, and maintenance unit 5 are connected to the output side of the control unit 6.

The conveyance mechanism 3 includes a paper feed roller pair that convey the printing paper P, a conveyance motor that turns as controlled by control signals from the control unit 6, and a drive power transfer mechanism that transfers rotation from the conveyance motor to the paper feed roller pair.

The head moving mechanism 4 includes a carriage that carries the printhead 2, a carriage guide rail that supports the carriage movably on the transverse direction B, a carriage motor that turns as controlled by a control signal from the control unit 6, and a pulley and timing belt mounted thereon that rotate according to rotation from the carriage motor.

The control unit 6 further includes a rendering unit 62, a color conversion processor 63, a digitizing processor 64, a print mode setting unit 65, a parameter decision unit 66, a flushing dot merging unit 67 (merging unit), a print data generating unit 68, a print control unit 69, and a regular flushing unit 70 (first flushing unit). The control unit 6 also has a conveyance control unit (not shown in the figure) that controls the conveyance mechanism 3 and conveys the Printing paper P at a specific speed.

A storage unit 61 stores a color conversion lookup table 71, an SML table 72, a parameter selection table 73, and flushing patterns 74 (74A, 74B).

Converting Input Data to Print Data

Figure 3:
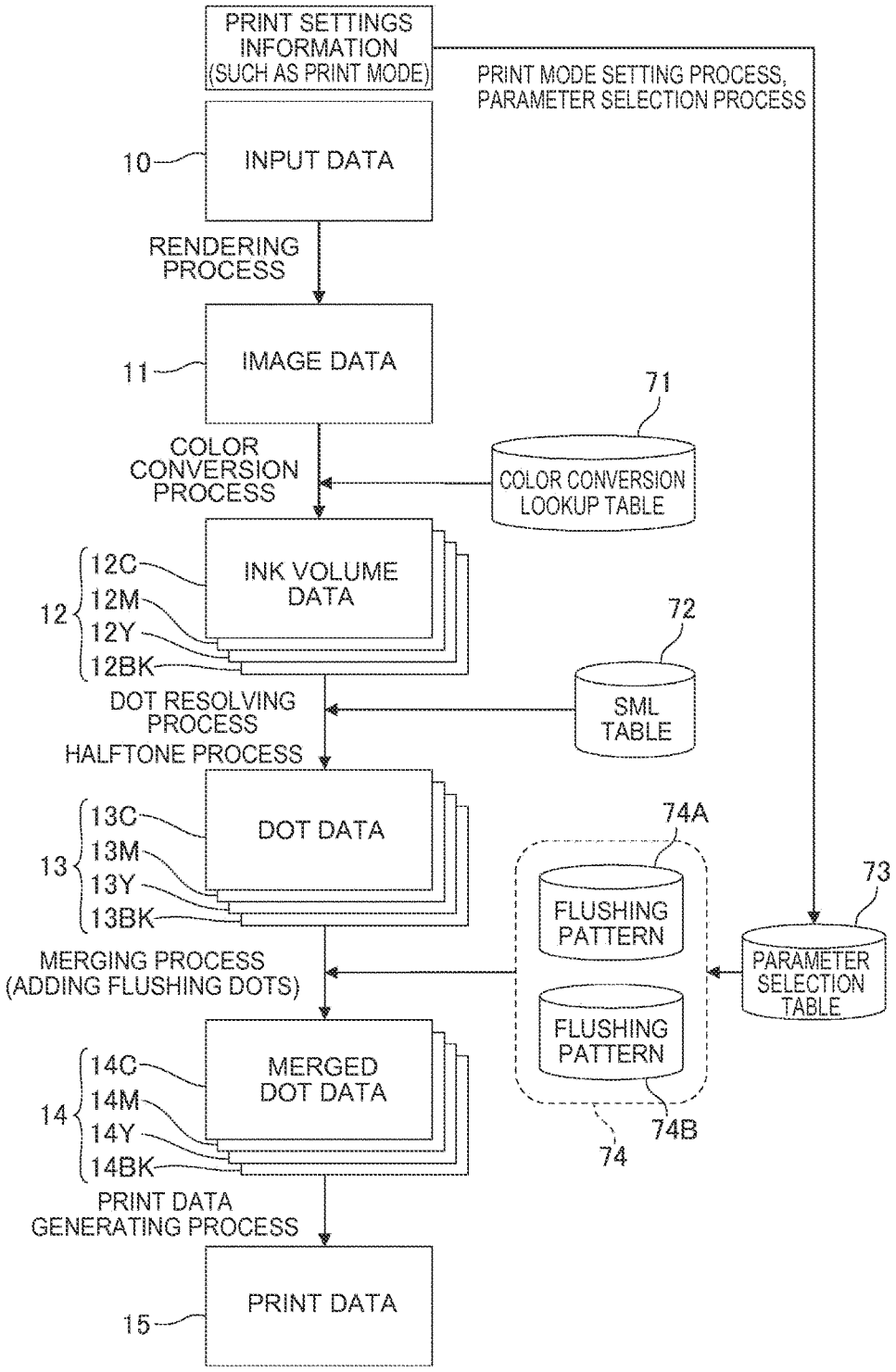
FIG. 3 illustrates the process of converting image data to print data.

FIG. 3 illustrates the process of converting input data to print data. The rendering unit 62 executes a rendering process that converts the input data 10 to be printed (such as image data) to image data 11 of a pixel count corresponding to the specified print size and resolution. More specifically, the rendering unit 62 enlarges or reduces the input data 10 to the specified print size, and then resolves the scaled input data 10 to the specified resolution. The pixels of the image data 11 resulting from the rendering process become color data in the RGB color space (binary RGB data).

The color conversion processor 63 then executes a color conversion process of referencing a color conversion lookup table 71 and converting the pixels (binary RGB data) in the image data 11 resulting from the rendering process to ink volume data 12 (12Bk, 12C, 12M, 12Y) for each of the four colors C, Y, M, Bk. The color conversion lookup table 71 stores ink volume data for the four colors C, Y, N, Bk relationally to the binary RGB data (combination of R, G, and B), which is color data in the RGB color space. In this example, the C, Y, M, Bk ink volume data is expressed as 8-bit (256 level) gray scale data.

The digitizing processor 64 then converts the ink volume data for each pixel in the ink volume data 12 (12Bk, 12C, 12M, 12Y) resulting from the color conversion process to dot data in the four levels of dots that can be formed by the ink nozzles 25.

The SML table 72 stores the gray level values of the C, Y, M, Bk ink volume data relationally to the incidence of four types of dots, including white dots. The four types of dots include Null (white dot), S (small dot), M (medium dot), and L (large dot). The digitizing processor 64 first executes a dot ratio decision process that references the SML table 72 and converts the ink volume data for each pixel to incidence data for the four types of dots, and then executes a halftone process that determines for each size of dot whether or not a dot is formed for each pixel. As a result, a print dot pattern 13 (13Bk, 13C, 13M, 13Y) specifying if one of the four types of print dots, including null dots, is formed at each pixel position is generated for each color. Note that a BRS correction process that corrects the ink volume data based on deviation in the arrangement of the ink nozzles 25 or deviation in ink ejection may be executed before converting the ink volume data 12 to dot data after the color conversion process.

The print mode setting unit 65 then sets the print mode based on the print settings information supplied to the control unit 6. In this example, two different print modes can be set: a print quality priority mode (first print mode) and a print time priority mode (second print mode). The print quality priority mode is a mode that maintains print quality. The print time priority mode is a mode that shortens the time required for printing compared with the print quality priority mode.

Based on the selected print mode, the parameter decision unit 66 determines the combination of regular flushing (first flushing) operations that eject ink into the maintenance unit 5, and onto-paper flushing (second flushing) operations that eject ink onto the printing paper P. The combination of regular flushing and onto-paper flushing operations performed when printing the input data 10 is determined with reference to a parameter selection table 73.

FIG. 4 shows an example of the parameter selection table 73. As shown in the figure, the parameter selection table 73 relationally stores the content of regular flushing and the content of onto-paper flushing operations performed in each print mode. The content of the regular flushing operations is determined by the frequency and strength of the regular flushing operation. The frequency indicates the interval between regular flushing operations, and in this example is set to either of two levels, a first frequency (such as a 10-20 ms interval), or a second frequency that is less frequent than the first frequency (such as a 1200 ms interval). Note that the second frequency is set to the time required to print one roll of paper or greater, and when roll paper is used as the printing paper P, enables printing one roll of paper without interruption by the regular flushing operation. The strength indicates how much ink is ejected for flushing, and in this example may be set to either of two levels, a first strength, and a second strength at which less ink is ejected than at the first strength setting.

The content of onto-paper flushing is set based on the density of the ink dots formed by onto-paper flushing (referred to below as "flushing dots"), and in this example may be set in two levels, a first density (such as 1000 dots/inch$^2$), or a second density that is lower than the first density (such as 200 dots/inch$^2$).

As shown in FIG. 4, the parameter selection table 73 sets the frequency of regular flushing to the first frequency (high frequency), the strength of regular flushing to the second strength (low ink ejection volume), and the flushing dot density of onto-paper flushing to the second density (low density), in the print quality priority mode.

In the print time priority mode, the parameter selection table 73 sets the frequency of regular flushing to the second frequency (low frequency), the strength of regular flushing to the first strength (high ink ejection volume), and the flushing dot density of onto-paper flushing to the first density (high density).

The combination of regular flushing and onto-paper flushing thus increases the flushing dot density of onto-paper flushing when the frequency of regular flushing is low, and when the frequency of regular flushing is high, lowers the flushing dot density of onto-paper flushing. The strength of regular flushing is also set to increase the ink ejection volume (increase the strength) when the regular flushing frequency is low.

The flushing dot merging unit 67 adds the flushing dots to the print dot patterns 13 (13Bk, 13C, 13M, 13Y) resulting from the halftone process, and creates merged dot patterns 14 (14Bk, 14C, 14M, 14Y). The flushing dots are added using flushing patterns 74 (see FIGS. 5A and 5B). The flushing patterns 74 are patterns specifying the ink nozzles 25 that are to eject ink droplets and the ejection timing during onto-paper flushing that ejects ink droplets onto the printing paper P when printing the input data 10. In this example, two flushing patterns 74 (74A, 74B) that differ in the density of the flushing dots are stored in the storage unit 61. More specifically, flushing pattern 74A is a pattern in which the density of the flushing dots is the first density (high density). Flushing pattern 74B is a pattern in which the density of the flushing dots is the second density (low density).

The flushing dot merging unit 67 selects one of flushing patterns 74A, 74B according to the content of the onto-paper flushing selected by the parameter decision unit 66. More specifically, the flushing dot merging unit 67 references the parameter selection table 73, and selects flushing pattern 74A in which the density of the flushing dots is the second density (low density) when in the print quality priority mode. When in the print time priority mode, the flushing dot merging unit 67 selects flushing pattern 74B in which the density of the flushing dots is the first density (high density).

Figure 5A:
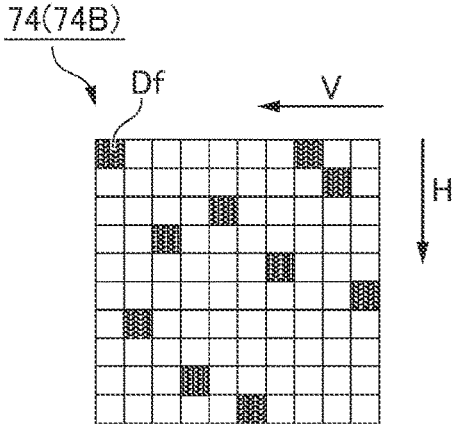
FIGS. 5A and 5B schematically illustrate the flushing pattern.
Figure 5B:
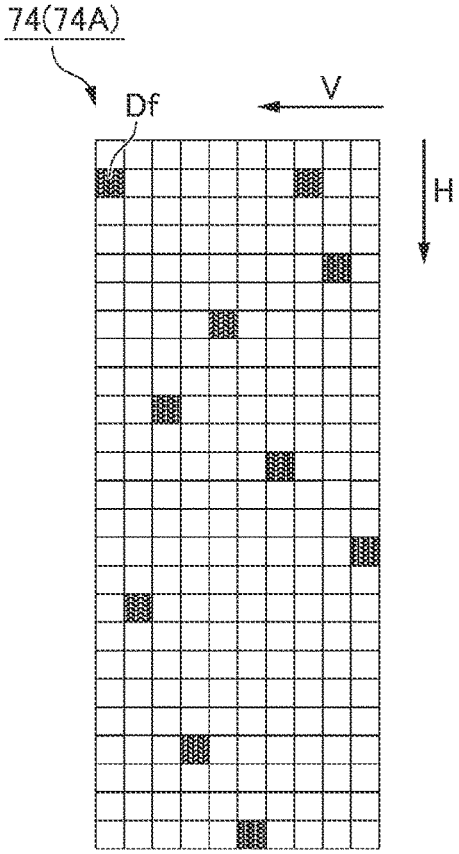

FIGS. 5A and 5B illustrate the flushing patterns 74 (74A, 74B), FIG. 5A showing the flushing pattern 74B of a first density (high density) and FIG. 5B showing a flushing pattern 74A of a second density (low density). As shown in the figures, the flushing patterns 74 (74A, 74B) are dot matrix patterns of null dots and flushing dots Df. For simplicity, FIGS. 5A and 5B show examples of 10 row by 10 column, and 10 row by 25 column, dot matrix patterns, but dot matrix patterns of different row and column counts can obviously be used. The row direction V of the flushing patterns 74 (74A, 74B) corresponds to the direction of the ink nozzle 25 arrays (that is, the transverse direction B). The column direction H of the flushing patterns 74 (74A, 74B) corresponds to the timing of the flushing operation. The size of the row direction V of the flushing patterns 74 (74A, 74B) substitutes the number of dots for the period of the flushing operation (that is, the period at Which a flushing dot Df is formed). The flushing patterns 74 (74A, 74B) are patterns for one period. The timing of the flushing operation is determined by the positions of the flushing dots Df in each row.

When flushing dots Df are added to the print dot patterns 13 (13Bk, 13C, 13M, 13Y), the print dot patterns 13 (13Bk, 13C, 13M, 13Y) are superimposed with the flushing patterns 74 (74A, 74B), and the print dot at a position where there is a flushing dot Df is combined with the flushing dot Df. If the flushing pattern 74 (74A or 74B) is smaller than the print dot pattern 13 (13Bk, 13C, 13M, 13Y), the flushing pattern 74 (74A or 74B) may be repeated in the column direction H and row direction V. The flushing pattern 74 (74A or 74B) is superimposed with the four print dot patterns 13 (13Bk, 13C, 13M, 13Y) offset a certain amount determined by the ink color. The process of merging print dots with flushing dots Df is a process that makes the larger dot size the size of the dot after merging. For example, if the dot size of the flushing dot Df is M, and the flushing dot Df is merged with a print dot of a size M or smaller, the size of the merged dot is M. If the flushing dot Df is merged with a print dot of size L, the size of the merged dot is L. The merged dot patterns 14 (14Bk, 14C, 14M, 14Y) are created by thus merging the flushing dots Df.

The print data generating unit 68 executes a print data generating process that creates the print data 15 used to drive the printhead 2 by assigning the dots of the merged dot patterns 14 (14Bk, 14C, 14M, 14Y) to the ink nozzles 25 of the inkjet heads 2C, 2M, 2Y, 2Bk. As described above, the ink nozzles 25 overlap in the conveyance direction A at the ends of the four head units 21 to 24. As a result, a mask process that assigns dots to the ink nozzles 25 of one of each two overlapping head units is therefore included in the print data generating process. If the dot assigned to ink nozzles 25 that overlap in the conveyance direction A is a dot combining a flushing dot Df and a print data, the mask process assigns the dot to both overlapping ink nozzles 25.

The print control unit 69 controls ejection of ink from the printhead 2 based on the print data 15 that Was generated. More specifically, based on the print data 15, the print control unit 69 generates a pulse of voltage applied to the piezoelectric device corresponding to an ink nozzle 25 as the nozzle drive signal, and supplies the pulse to the printhead 2. As a result, the printhead 2 is driven, ink droplets are ejected from the ink nozzles 25 of the inkjet heads 2C, 2M, 2Y, 2Bk, and the content specified by the input data 10 and the print settings information is printed.

When ejecting ink from the ink nozzles 25 and printing the input data 10 based on the generated print data 15, the regular flushing unit 70 executes the regular flushing operation ejecting ink from the ink nozzles 25 to the maintenance unit 5 according to the content (strength and frequency) of the regular flushing operation determined by the parameter decision unit 66. More specifically, the regular flushing unit 70 drives the head moving mechanism 4 according to the set frequency, and moves the printhead 2 to the retracted position D opposite the maintenance unit 5. The regular flushing unit 70 then drives the printhead 2 to eject ink into the maintenance unit 5 in the regular flushing operation.

Printing Method

A printer 1 thus comprised prints as described below. When image data or other input data 10 and print settings information are received through the communication unit 7, the control unit 6 of the printer 1 applies the rendering process, color conversion process, and digitizing process (dot ratio decision process and halftone process) to the input data 10. The control unit 6 also sets the print mode based on the print settings information, references the parameter selection table 73, and determines the content of the regular flushing operation ejecting ink to the maintenance unit 5 and the onto-paper flushing operation that ejects ink onto the printing paper P. The control unit 6 then applies the merging process adding the flushing dots Df to the print dot patterns 13 (13Bk, 13C, 13M, 13Y) generated from the input data 10 according to the content of the onto-paper flushing operation, and generates print data 15 based on the merged dot patterns 14 (14Bk, 14C, 14M, 14Y).

The control unit 6 also drives the conveyance mechanism 3 to convey the printing paper P to the printhead 2, and positions the beginning of the print area on the printing paper P to the print position of the printhead 2. When positioning the printing paper P is completed, the control unit 6 supplies drive signals to the printhead 2 based on the print data 15. As a result, the printhead 2 is driven, ink droplets are ejected from the ink nozzles 25 of the inkjet heads 2C, 2M, 2Y, 2Bk, and the content specified by the input data 10 and the print settings information is printed.

The control unit 6 also drives the printhead 2 based on the print data 15 to eject, ink onto the printing paper P, and drives the conveyance mechanism 3 to convey the printing paper P.

The control unit 6 also drives the head moving mechanism 4 at the frequency determined by the content of the regular flushing operation, and moves the printhead 2 to the retracted position D opposite the maintenance unit 5. The control unit 6 then drives the printhead 2 to eject ink into the maintenance unit 5 in the regular flushing operation.

Because flushing dots Df are added to the print data 15, the ink dot (print dot) formation operation that forms the pixels of the input data 10, and the ink dot (flushing dot) formation operation that flushes the ink nozzles 25, are performed by driving the printhead 2 and ejecting ink to the printing paper P based on the print data 15. More specifically, both printing an image or other content on the printing paper P, and onto-paper flushing, are performed.

As described above, the printer 1 according to this embodiment executes a flushing parameter decision process that determines the combination of regular flushing that ejects ink from the ink nozzles 25 of the printhead 2 to the maintenance unit 5, and onto-paper flushing that ejects ink onto the printing paper P, to perform when printing the input data 10 based on the print mode and other print settings information.

Based on the determined combination of flushing parameters, the flushing dots Df that are formed in the onto-paper flushing operation are added to the input data 10 to be printed (specifically, the print dot patterns 13 converting the pixels in the rendered image data 11 to ink dots), creating merged dot patterns 14. The printing process that ejects ink onto the printing paper P based on the merged dot patterns 14 is executed, and regular flushing based on the selection combination of parameters is executed during the printing process. By thus combining regular flushing, which does not cause a drop in print quality, with onto-paper flushing, which does not cause a drop in throughput, according to the print mode, printing can proceed while balancing print quality and throughput according to the application or printing conditions, and ink ejection problems can be prevented in the ink nozzles 25.

More specifically, this embodiment of the invention provides two print modes, a print quality priority mode and a print time priority mode. In the print quality priority mode, the frequency of regular flushing, which does not lower print quality, increases and the density of onto-paper flushing decreases. In the print time priority mode that prioritizes throughput, the density of onto-paper flushing, which does not lower throughput, increases and the frequency of regular flushing decreases. As a result, printing can proceed while balancing print quality and throughput according to the selected priority.

Other Embodiments

The combination of the regular flushing and onto-paper flushing operations is determined according to the print mode in the embodiment described above, but the combination can be determined according to print settings information other than the print mode, such as the print speed or print resolution.

Figures 6, 7:
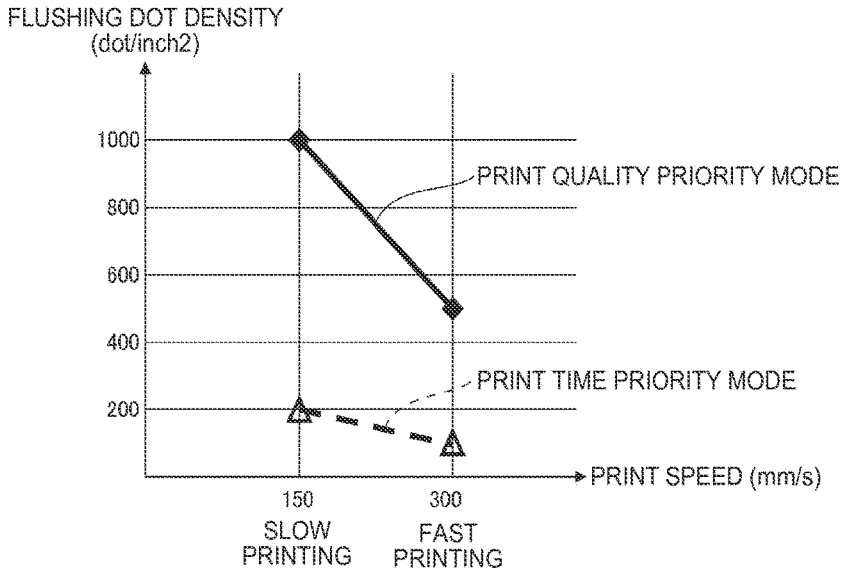
FIG. 6 shows another example of a flushing parameter table.
FIG. 7 is a graph showing the correlation between print speed and flushing dot density.

FIG. 6 illustrates a table of combinations in another example. In this example the print speed can be set to either of two levels, and either fast printing (30 mm/s) or slow printing (150 mm/s) can be selected in the print settings. In this event, the control unit 6 has a speed setting unit, and sets the print speed based on the print speed setting supplied to the control unit 6. In the parameter selection table 173 in this example, the content of regular flushing and the content of onto-paper flushing are set according to the print speed.

More specifically, in the fast print mode, the same parameter combination used in the print time priority mode above (that is, the frequency of regular flushing is the second frequency (low frequency)) the strength of regular flushing is the first strength (high ink ejection volume), and the flushing dot density of onto-paper flushing is the first density (high density)) is used.

In the slow print mode, the same combination used in the print quality priority mode (that is, the frequency of regular flushing to the first frequency (high frequency), the strength of regular flushing is the second strength (low ink ejection volume), and the flushing dot density of onto-paper flushing is the second density (low density)) is used.

FIG. 7 is a graph showing the correlation between print speed and the flushing dot density. As shown in the graph, the flushing dot density changes inversely proportionally to the print speed. However, because the print resolution (that is, the print dot density) is inversely proportional to the print speed (paper feed speed), the same flushing patterns used to add the flushing dots Df can be used.

Based on the print speed setting, the parameter selection table 173 is referenced to determine the combination of regular flushing and onto-paper flushing settings. As a result, the density of onto-paper flushing, which does not lower throughput, can be increased and the frequency of regular flushing decreased for fast printing. For low speed printing, the frequency of regular flushing, which does not lower print quality, can be increased and the density of onto-paper flushing decreased. As a result, printing can proceed while balancing print quality and throughput according to the print speed setting selected by the user.

The combination of regular flushing and onto-paper flushing parameters can also be determined according to the print resolution (quality) instead of the print speed.

More specifically, two print resolution (quality) settings can be selected, and high print quality with a high print resolution, or low print quality with low print resolution, can be selected according to the print Setting. In this event, the control unit 6 has a print quality setting unit, and sets the print resolution based on the print quality setting supplied to the control unit 6. In this event, as shown in FIG. 6, fast printing is replaced with low print quality, and slow printing is replaced with high print quality. As a result, printing can proceed while balancing print quality and throughput according to the print quality setting selected by the user.

Note that in a printer in which the print mode, print speed, and print resolution can be independently adjusted, a parameter selection table setting the combination of regular flushing and onto-paper flushing parameters is compiled according to the possible combinations of these print settings, and this table can be referenced to appropriately adjust the content of the regular flushing and onto-paper flushing operations.

The invention being thus described, it will be obvious that it may be varied in many ways. Such variations are not to be regarded as a departure from the spirit and scope of the invention, and all such modifications as would be obvious to one skilled in the art are intended to be included Within the scope of the following claims.

What is claimed is:

1. A printer comprising:

a printhead with ink nozzles; a maintenance unit that receives ink ejected from the ink nozzles; a head moving mechanism that moves the printhead to a print position to print on a recording medium, and a maintenance position to eject ink to the maintenance unit;

a parameter decision unit that determines a combination of first flushing conditions for flushing the ink nozzles by ejecting ink to the maintenance unit, and second flushing conditions for flushing the ink nozzles by ejecting ink onto the recording medium;

a merging unit that generates merged data adding to image data a pattern of flushing dots that are formed by the second flushing based on the selected second flushing conditions;

a first flushing unit that applies the first flushing based on the selected first flushing conditions to the printhead; and a print quality setting unit that sets the print resolution; the parameter decision unit determining the combination of first flushing conditions and second flushing conditions based on the set print resolution.

2. The printer described in claim 1, wherein:

the parameter decision unit sets the frequency of the first flushing to either a first frequency or a second frequency that is less frequent than the first frequency as a condition of the first flushing.

3. The printer described in claim 1, wherein:

the parameter decision unit sets the density of flushing dots formed in the second flushing to either a first density or a second density that is less dense than the first density as a condition of the second flushing.

4. The printer described in claim 1, wherein:

the parameter decision unit sets the strength of the first flushing to either a first strength or a second strength that ejects less ink than the first strength as a condition of the first flushing.

5. A printing method comprising:

determining a combination of first flushing conditions for flushing the ink nozzles by ejecting ink from ink nozzles of a printhead to a maintenance unit, and second flushing conditions for flushing the ink nozzles by ejecting ink onto a recording medium;

generating merged data adding to image data a pattern of flushing dots that are formed by the second flushing based on the selected second flushing conditions;

ejecting ink onto the recording medium based on the merged data;

applying the first flushing based on the selected first flushing conditions;

setting the print resolution; and determining the combination of first flushing conditions and second flushing conditions based on the set print resolution.

6. The printing method described in claim 5, further comprising:

setting the frequency of the first flushing to either a first frequency or a second frequency that is less frequent than the first frequency as a condition of the first flushing.

7. The printing method described in claim 5, further comprising:

setting the density of flushing dots formed in the second flushing to either a first density or a second density that is less dense than the first density as a condition of the second flushing.

8. The printing method described in claim 5, further comprising:

sets the strength of the first flushing to either a first strength or a second strength that ejects less ink than the first strength as a condition of the first flushing.

* * * * *